United States Patent [19]

Moreland

[11] 4,073,493

[45] Feb. 14, 1978

[54] BRIDGE BID RECORDING DEVICE

[76] Inventor: Stephen T. Moreland, 789 Anita Ave., Grosse Pointe Woods, Mich. 48236

[21] Appl. No.: 710,234

[22] Filed: July 30, 1976

[51] Int. Cl.[2] ..... A63F 1/18

[52] U.S. Cl. ..... 273/148 R; 116/136

[58] Field of Search ..... 273/148 R, 148 A, 131 BA, 273/134 GM, 136 C; 116/136; 235/90

[56] References Cited

U.S. PATENT DOCUMENTS

| | | | |
|---|---|---|---|
| D. 91,962 | 4/1934 | Pawlinger | 116/136 UX |
| 375,558 | 12/1887 | Massa | 273/148 A UX |
| 1,656,993 | 1/1928 | Searle | 273/148 R |
| 3,185,481 | 5/1965 | Watkins | 273/148 R |

FOREIGN PATENT DOCUMENTS

| | | | |
|---|---|---|---|
| 103,798 | 2/1917 | United Kingdom | 116/136 |

*Primary Examiner*—Anton O. Oechsle

*Attorney, Agent, or Firm*—Barnes, Kisselle, Raisch & Choate

[57] ABSTRACT

A device for recording and retaining the bids of a player in a bridge auction comprising a block having a plurality of holes formed in a rectangular row and column array therein, each row and column being respectively associated with a particular level and type of bid, and a plurality of tokens selectively insertable into the holes for indicating the type and level of a player's bid during each bidding round.

11 Claims, 7 Drawing Figures

BRIDGE BID RECORDING DEVICE

The present invention relates to recording devices and, more particularly, to a device for recording and retaining the bids of a player during a game of bridge.

In the card game of bridge, it is often advantageous to record and retain the sequence of bids entered by each player for analysis and discussion after the bidding auction or after the hand has been completed. This is particularly true in the case of a player or group of players who are learning to bid and play a bridge hand. It is an object of the present invention to provide a compact and inexpensive device upon which a player's bids may be rapidly recorded in sequence, which will retain all bids so recorded for analysis, which may be easily and readily interpreted upon completion of the auction, and/or which may be rapidly "erased" and prepared for subsequent reuse.

The novel features which are considered to be characteristic of the invention are set forth in particular in the appended claims. The invention itself, however, together with additional objects, features and advantages thereof, will be best understood from the following description when read in conjunction with the accompanying drawings in which:

Figure 1:
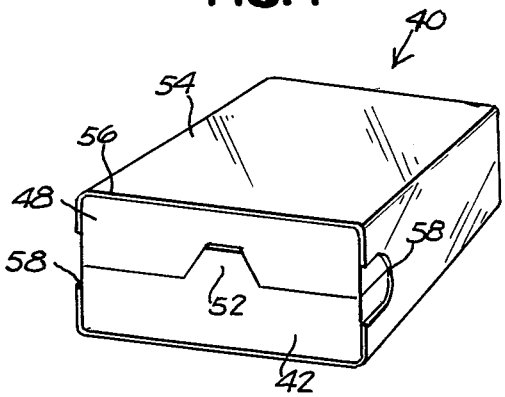
FIG. 1 is a perspective view of a presently preferred embodiment of the invention packaged in the form of a kit.

Referring to the drawings, the device provided by the invention comprises a generally rectangular recording block 10 having a plane upper surface 12 and four sides 14,16,18 and 20 formed along successive side edges of surface 12. Block 10 includes a plurality of holes 22 formed perpendicularly of surfaces 12 in a rectangular array of seven rows parallel to sides 14,18 and six columns parallel to sides 16,20. First indicia, generally indicated at 24, is provided on at least side 14, and is preferably mirrored on parallel side 18 in line with associated columns of holes 22 for identifying each such column with one type of bid — i.e., pass, a trump suit or no-trump. Indicia 24 is preferably arrayed from left to right as viewed in FIG. 3 in the conventional ascending order of rank: pass **24*a*, clubs 24*b*, diamonds 24*c*, hearts 24*d*, spades 24*e* and no-trump 24*f*. Similarly, second indicia 26 is provided on at least one, and preferably both of the sides 16,20 in line with associated rows of holes 22 for identifying each such row with a particular magnitude or level of bid, second indicia 26 being arrayed from right to left as viewed in FIG. 4 in ascending levels: one 26*a*, two 26*b*, three 26*c*, four 26*d*, five 26*e*, six 26*f* and seven 26*g*. Thus, block 10 may be positioned with side 14** facing forward, such that the bid types are arrayed from left to right and the bid levels are arrayed from front to rear for rapid location of the hole corresponding to a bid of any selected type and level.

Figure 3:
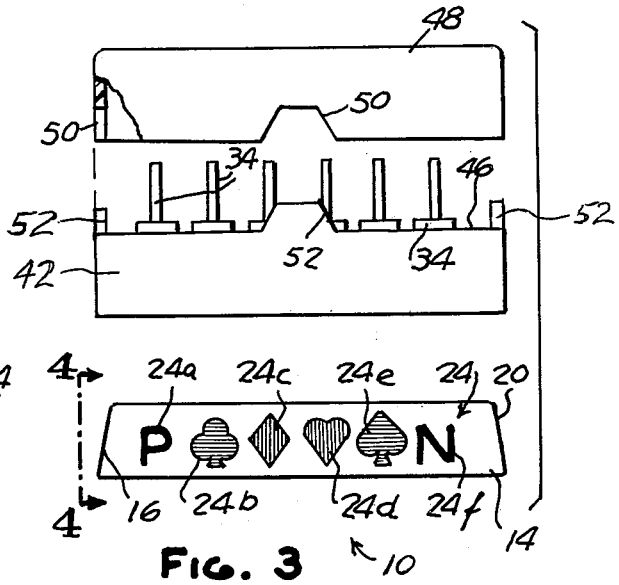
FIG. 3 is an exploded elevational view of the package shown in FIG. 2.
Figure 4:
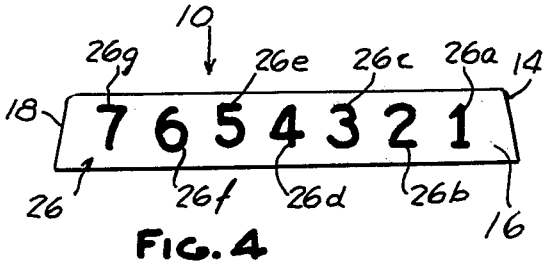
FIG. 4 is a side elevational view of a preferred embodiment of a bid recording block provided by the invention, and is taken along the line 4–4 of FIG. 3.

Block 10 may be formed of molded plastic, for example, with indicia 24,26 visibly presented as either raised or depressed alphanumeric characters. Alternatively, such indicia may be painted on corresponding sides of block 12. Sides 14–20 flare slightly outwardly from the side edges of upper surface 12, as best seen in FIGS. 3 and 4, to facilitate reading of indicia 24 or 26 provided thereon, and also to facilitate the preferred method of forming block 12 in a plastic mold.

Figure 5:
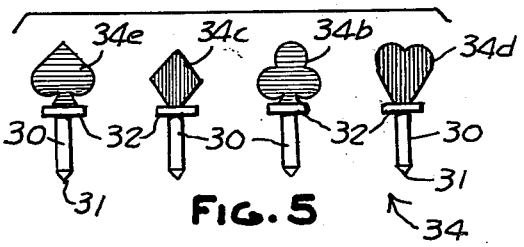
FIGS. 5 and 6 are elevational views of preferred embodiments of recording tokens provided by the invention.
Figure 6:
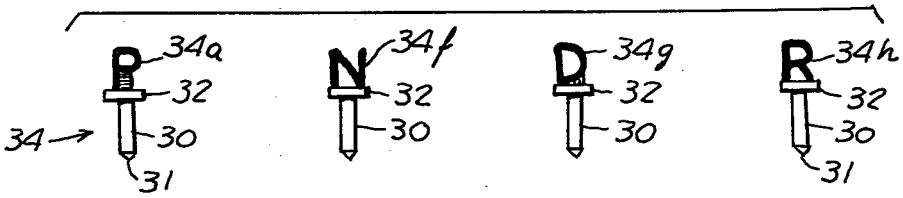

The recording device provided by the invention also includes a plurality of tokens 34 (FIGS. 5 and 6) formed of molded plastic, for example, and selectively insertable into block holes 22 for indicating the type and level of a player's bid during each round of bidding. Each token 34 comprises a cylindrical shank 30 terminating in a point 31 at one end to facilitate insertion into holes 22, and terminating at the other end in a collar 32 adapted to rest upon block surface 12 to support the corresponding token when shank 30 is inserted into a selected hole. Preferably, each token further includes an integral head formed to identify the associated token with one bid type. The presently preferred configuration of each such token head is illustrated in FIGS. 5 and 6 by bid types as follows: pass **34*a*, clubs 34*b*, diamonds 34*c*, hearts 34*d*, spades 34*e*, no-trump 34*f*, double 34*g* and redouble 34*h***.

Figure 7:
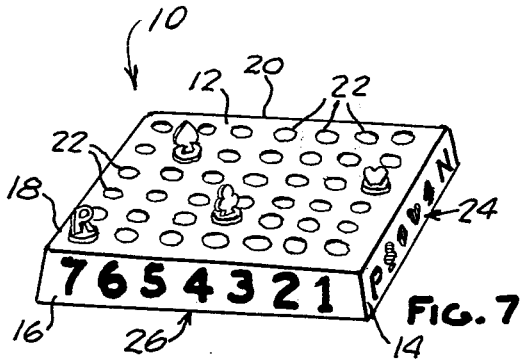
FIG. 7 is a perspective view of the recording block shown in FIGS. 3 and 4 with various tokens selectively inserted therein.

In operation, i.e., during a bridge auction, a player selects a token and hole corresponding to the type and level of his bid as each such bid is entered, and inserts the selected token into the corresponding hole. For maximum benefit in accordance with educational aspects of the invention, both players in a partnership, and preferably each of the four bridge players, should have his own block and array of tokens. The bids are recorded during each bidding round so that, at the end of the auction, the four blocks collectively contain a record of the entire auction sequence. By way of example, the block and token array depicted in FIG. 7 indicates that the associated player bid as follows in successive rounds: one heart, four clubs, six spades, redouble. Such record will be retained indefinitely so that the propriety of each bid may be analyzed and discussed at the end of the auction or after the hand has been played. When desired, the record may be erased by simply removing the tokens from each block, whereupon the blocks and tokens are ready for reuse.

The recording device provided herein is preferably packaged in the form of a kit 40 (FIGS. 1–3) which includes a rack 42 shaped in the form of an inverted cup to telescopically receive recording block 10. A plurality of forty-two holes 44 is formed in a row and column array on the shelf portion 46 of rack 42 for registry with holes 22 when block 10 is fitted beneath the shelf. A plurality of tokens 34, including six pass tokens, six tokens for each card suit, six no-trump tokens, three double tokens and three redouble tokens, is supported by rack 42 with token shanks 30 extending through shelf holes 44 into corresponding aligned block holes 22 as depicted in FIG. 2. When kit 40 is disassembled for use, rack 42 may be used to hold the tokens not being used for recording purposes in block 10. A rectangular cup-shaped cover 48 has an open rim adapted to rest upon rack shelf 46, such that cover 48 will enclose and protect the tokens and prevent accidental removal of the tokens from the rack should the assembled kit become inverted. A plurality of frustoconical notches 50 are formed in the open rim of cover 48 for engagement with corresponding dogs 52 extending upwardly from shelf 46 to prevent cover 48 from sliding with respect to rack 42 in the assembled condition of the kit.

Figure 2:
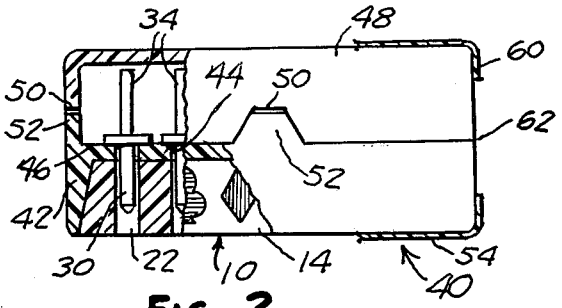
FIG. 2 is an elevational, partially sectioned side view of the package shown in FIG. 1.

The telescoped assembly of block 10, rack 42, the tokens and cover 48 is enclosed by a close-fitting protective sleeve 54 (FIGS. 1 and 2). Sleeve 54 has an open mouth 56 (FIG. 1) with a pair of cutout sections 58 formed at opposing sides thereof to facilitate gripping and extraction of the internal assembly. The opposing end of sleeve 54 is partially closed by a continuous lip 60 (FIG. 2) extending inwardly from the sleeve sides to limit insertion of the telescoped cover, rack and block. An open window 62 is formed by lip 60 and provides an area through which the telescoped assembly may be axially pushed to facilitate disassembly. As presently contemplated, kit 40 would preferably be suitably packaged and sold in quantities of four.

The invention claimed is:

1. A device in the form of a kit for recording and retaining the bids of a player in a game of bridge comprising a block having a seven row and six column rectangular array of holes formed therein and including means associating each said column with one of the bid types: pass, clubs, diamonds, hearts, spades and no-trump, and means associating each said row with one of the bid levels: one through seven; and a plurality of tokens selectively insertable into each said hole for indicating the type and level of a player's bid during each round of bidding including means integral with each said token identifying each said token with a selected bid type, said plurality of tokens including six pass, six club, six diamond, six heart, six spade, six no-trump, three double and three redouble tokens.

2. The device set forth in claim 1 wherein said kit further comprises a rack having 42 holes formed therein for holding said tokens when said tokens are not in use.

3. The device set forth in claim 2 wherein said rack is formed as an inverted cup having an opening to telescopically receive said block and a shelf portion in which said forty-two holes are formed, each of said forty-two holes being aligned with a corresponding hole in said block when said block is received within said rack.

4. The device set forth in claim 3 wherein each said token comprises a shank received in aligned holes in said block and said rack, and a head extending above said rack for identifying said token with a selected bid type, and wherein said kit further comprises a cover adapted to rest upon said shelf portion to enclose said token head and retain said tokens in said rack.

5. The device set forth in claim 4 wherein said kit further comprises means for preventing said cover from sliding with respect to said shelf portion.

6. The device set forth in claim 4 wherein said kit further comprises means encompassing said cover, said rack and said block for holding said block beneath said rack and said cover on said shelf portion of said rack.

7. A device for recording and retaining the bids in a game of bridge comprising a block member having a seven row and six column rectangular array of holes formed therein and including means associating each said column with one of the bid types: pass, clubs, diamonds, hearts, spades and no-trump and means associating each said row with one of the bid levels: one through seven; and a plurality of tokens selectively insertable into each said hole for indicating the type and level of a player's bid during each round of bidding including means integral with each said token identifying each said token with a selected bid type, said plurality of tokens including six pass, six club, six diamond, six heart, six spade, six no-trump, three double and three redouble tokens.

8. A device for recording and retaining the bids of a single player in a game of bridge comprising means providing a plurality of holes formed in a rectangular array of seven rows and six columns; first means identifying each said column with one of the bid types: pass, clubs, diamonds, hearts, spades, and no-trump; second means identifying each said row with the one of the bid levels: one through seven; and a plurality of tokens selectively insertable into each said hole for indicating the type and level of a player's bid during each round of bidding, said tokens including means associating respective ones of said tokens with the bid types: pass, clubs, diamonds, hearts, spades, no-trump, double and redouble.

9. The device set forth in claim 8 wherein said first and second identifying means are positioned along mutually orthogonal side edges of said array.

10. The device set forth in claim 9 wherein said hole-providing means comprises a block having a plane surface through which said plurality of holes is formed.

11. The device set forth in claim 10 wherein said block is generally rectangular having successively perpendicular side edges, said first and second identifying means being respectively formed adjacent at least two of said side edges orthogonal to each other.

* * * * *